US005539167A

United States Patent [19]

Hood et al.

[11] Patent Number: 5,539,167

[45] Date of Patent: Jul. 23, 1996

[54] BLADE SUSPENSION ASSEMLBY FOR A CIRCUIT BREAKER

[75] Inventors: Teresa I. Hood, Coralville; Joel L. Miller; John M. Winter, both of Cedar Rapids; Christopher K. Goble, Marion, all of Iowa

[73] Assignec: Square D. Company, Palatine, Ill.

[21] Appl. No.: 195,959

[22] Filed: Feb. 14, 1994

[51] Int. Cl.[6] ..... H01H 73/04

[52] U.S. Cl. ..... 200/244; 200/250

[58] Field of Search ..... 200/244, 250, 200/401

[56] References Cited

U.S. PATENT DOCUMENTS

| | | | |
|---|---|---|---|
| 3,908,104 | 9/1975 | Michetti | 200/250 X |
| 3,943,316 | 3/1976 | Oster | 200/337 |
| 3,943,472 | 3/1976 | Oster et al. | 335/16 |
| 3,944,953 | 3/1976 | Oster | 335/23 |
| 3,946,346 | 3/1976 | Oster et al. | 335/16 |
| 4,163,881 | 8/1979 | Borona et al. | 200/401 |
| 4,417,223 | 11/1983 | Bancalari | 335/195 |
| 4,472,701 | 9/1984 | Bellows et al. | 200/250 X |
| 4,482,877 | 11/1984 | Castunguay et al. | 200/244 X |
| 4,740,768 | 4/1988 | Morris et al. | 335/22 |
| 5,003,139 | 3/1991 | Edds et al. | 200/401 |
| 5,073,764 | 12/1991 | Takahashi et al. | 335/16 |
| 5,075,657 | 12/1991 | Rezac et al. | 335/6 |
| 5,097,589 | 3/1992 | Rezac et al. | 29/622 |
| 5,159,304 | 10/1992 | Yamagata et al. | 335/202 |
| 5,245,302 | 9/1993 | Brune et al. | 335/35 |

FOREIGN PATENT DOCUMENTS

| | | | |
|---|---|---|---|
| 279533 | 11/1988 | Japan | 200/250 |

*Primary Examiner*—Renee S. Luebke

*Attorney, Agent, or Firm*—Larry I. Golden; Kareem M. Irfan; Wayne H. Stoppelmoor

[57] ABSTRACT

A blade suspension assembly for a circuit breaker comprises a pivot pin, a torsion spring, an elongated blade, and a blade carrier. The torsion spring includes a lateral middle section, a pair of end legs disposed on opposite sides of the middle section, and a lateral hole extending therethrough. The blade includes an electrical contact mounted thereto, a lower bearing surface, and a lateral circular aperture. The blade carrier includes first and second pairs of bearing surfaces. To assemble the blade suspension assembly, the torsion spring is placed over the blade with the lateral middle section abutting the lower bearing surface of the blade, with the end legs disposed on opposite sides of the blade, and with the lateral hole in the torsion spring disposed in line with the circular aperture in the blade. Next, the pivot pin is inserted through the lateral hole in the torsion spring and through the circular aperture in the blade. The combination of the blade, the torsion spring, and the pivot pin is then inserted into the blade carrier with the pair of end legs abutting respective ones of the first pair of bearing surfaces and opposite ends of the pivot pin abutting respective ones of the second pair of bearing surfaces.

8 Claims, 5 Drawing Sheets

BLADE SUSPENSION ASSEMLBY FOR A CIRCUIT BREAKER

FIELD OF THE INVENTION

The present invention generally relates to circuit breakers, and more particularly, to a blade suspension assembly for a circuit breaker which provides improvements in terms of operation, ease of manufacturing and assembly, and reliability.

BACKGROUND OF THE INVENTION

Circuit breakers are commonly used for providing automatic circuit interruption upon detection of undesired overcurrent conditions on the circuit being monitored. These overcurrent conditions include, among others, overload conditions, ground faults and short-circuit conditions.

Circuit breakers typically include an electrical contact on a movable arm which rotates away from a stationary contact in order to interrupt the current path. The type of overcurrent condition dictates how quickly the arm must rotate. For example, in response to overcurrent conditions at relatively low magnitudes but present for a long period of time, circuit breakers generally move the arm to break the current path by tripping a spring-biased latch mechanism which forces the contact on the arm away from the fixed contact. Spring-biased latch mechanisms are usually relatively slow. In response to overcurrent conditions at relatively high magnitudes, circuit breakers must break (or blow-open) the current path very quickly, reacting much faster than the reaction time for known spring-biased latch mechanisms. In either case, the contact arm must rotate to an open position as fast, as simply and as reliably as possible.

Circuit breaker designs attempting to achieve these objectives of quickness and reliability have failed. For example, most circuit-breaker blade suspension mechanisms require complex manual assembly involving high part count, intricate positioning of one or more drive pins and one or more torsion springs for biasing movable arms, and their overall intricate assembly prohibits late point assembly adjustments, field adjustment and/or service. In addition, the complex design of most circuit-breaker blade suspension mechanisms is not conducive to straight-pull molding techniques during manufacturing.

Many conventional circuit-breaker blade suspension mechanisms also exhibit problems in terms of their operation. These problems include slow contact arm rotation, the contact arm rebounding to the closed-contact position during interruption, breakage of the crossbar used to support the contact arm, and inconsistent contact force characteristics.

Generally, the speed and reliability at which the blade suspension mechanism breaks the current path is directly related to the complexity of the blade suspension mechanism, i.e., the faster the mechanism and the higher its reliability, the more complex the mechanism.

Accordingly, there is a need for a blade suspension assembly for a circuit breaker which overcomes the above-mentioned deficiencies of the prior art.

SUMMARY OF THE INVENTION

The present invention provides a blade suspension assembly for a circuit breaker which affords improvements in terms of operation, ease of manufacturing and assembly, and reliability.

In one particular embodiment, the blade suspension assembly comprises a pivot pin, a torsion spring, an elongated blade, and a blade carrier. The torsion spring includes a lateral middle section, a pair of end legs disposed on opposite sides of the middle section, and a lateral hole extending therethrough. The blade includes an electrical contact mounted thereto, a lower bearing surface, and a lateral circular aperture. The blade carrier includes first and second pairs of bearing surfaces.

To assemble the blade suspension assembly, the torsion spring is placed over the blade with the lateral middle section abutting the lower bearing surface of the blade, with the end legs disposed on opposite sides of the blade, and with the lateral hole in the torsion spring disposed in line with the circular aperture in the blade. Next, the pivot pin is inserted through the lateral hole in the torsion spring and through the circular aperture in the blade. The combination of the blade, the torsion spring, and the pivot pin is then inserted into the blade carrier with the pair of end legs abutting respective ones of the first pair of bearing surfaces and opposite ends of the pivot pin abutting respective ones of the second pair of bearing surfaces. In accordance with the foregoing assembly, the torsion spring biases the blade toward a closed position with the electrical contact abutting an opposing stationary contact of the circuit breaker.

BRIEF DESCRIPTION OF THE DRAWINGS

Other objects and advantages of the invention will become apparent upon reading the following detailed description and upon reference to the drawings in which.

Figure 1:
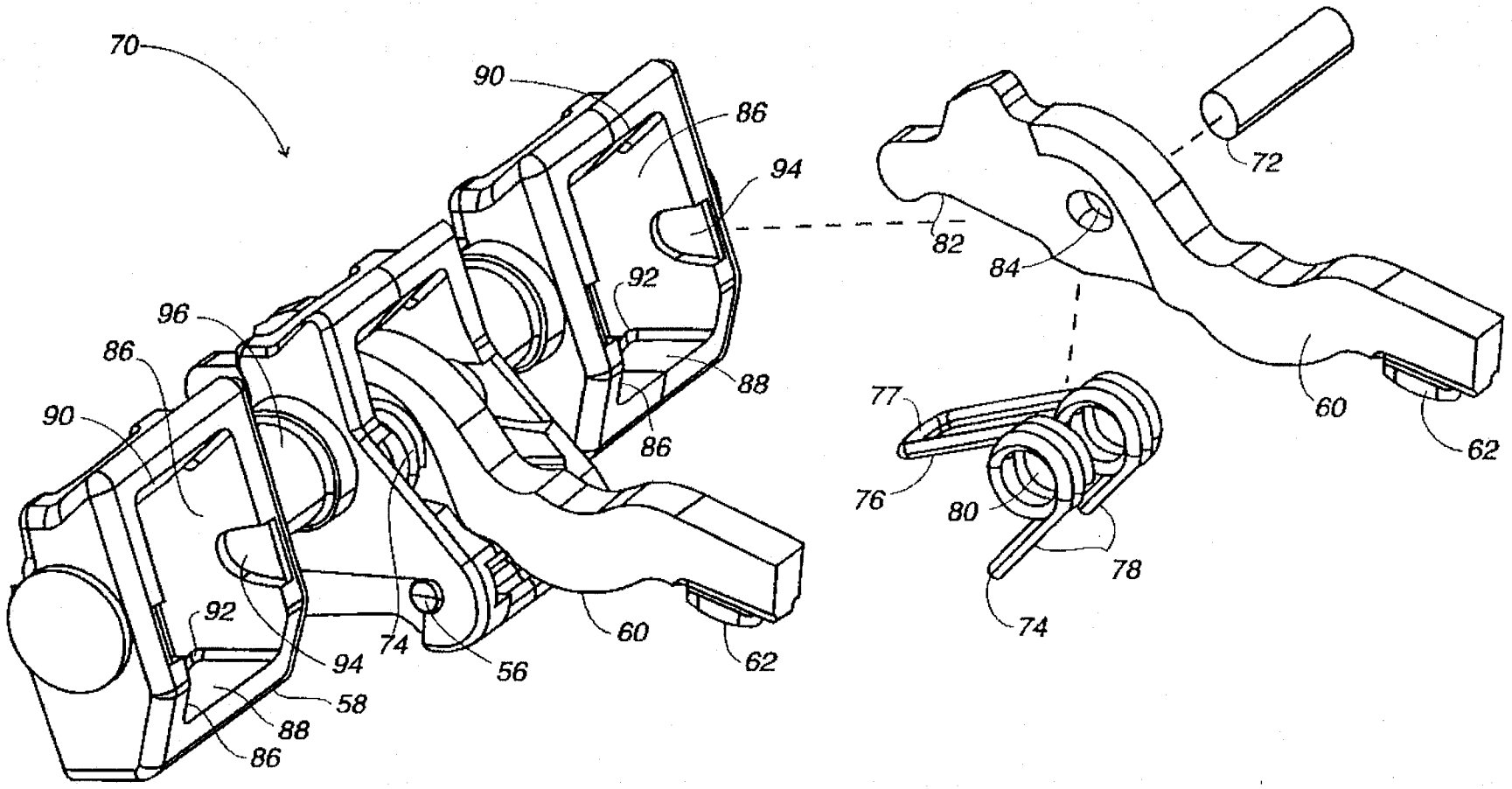
FIG. 1 is a partially exploded perspective view of the blade suspension assembly embodying the present invention.
Figure 2:
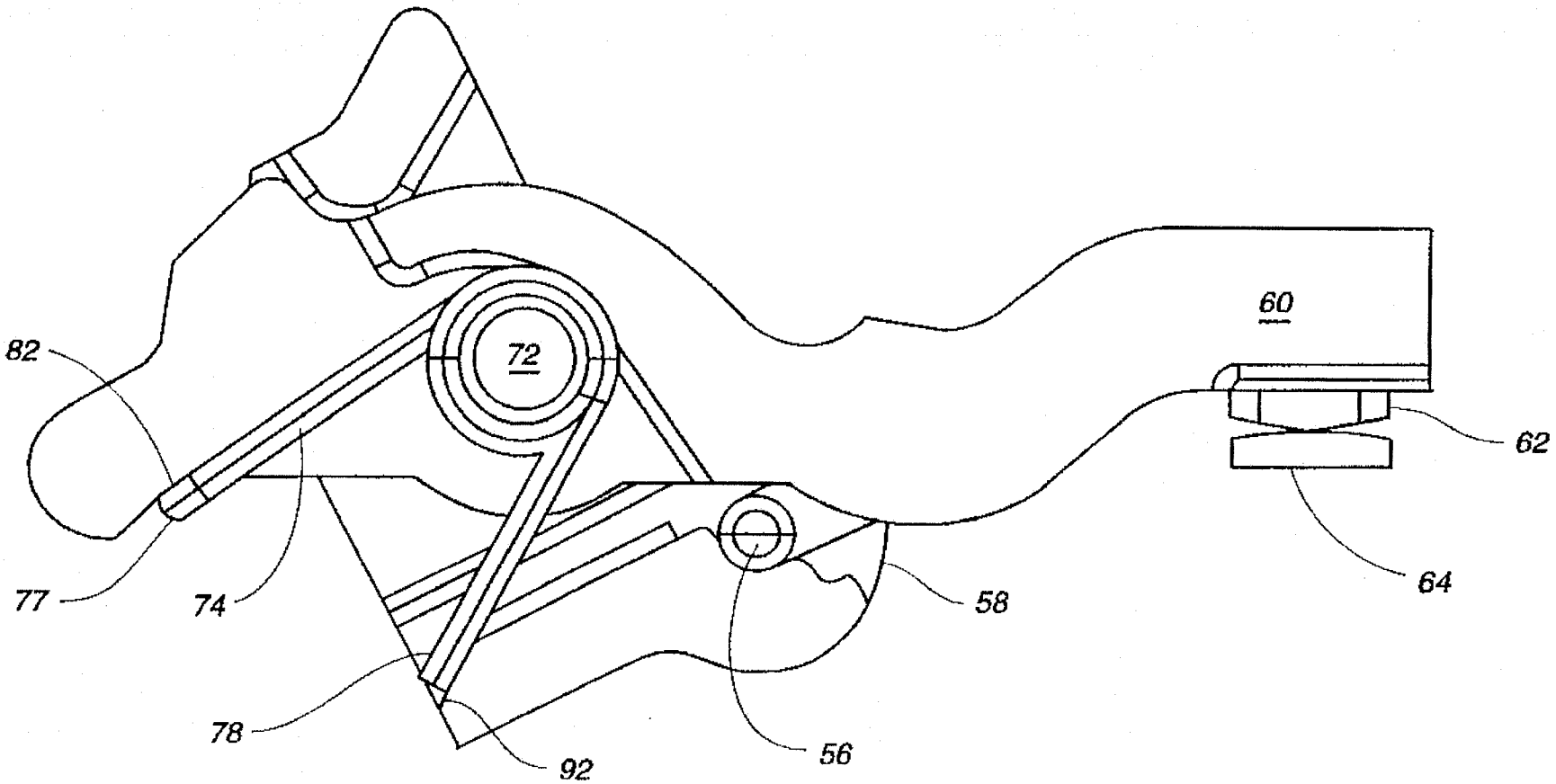
FIG. 2 is a side view of the blade suspension assembly in FIG. 1, shown in the untripped position.
Figure 3:
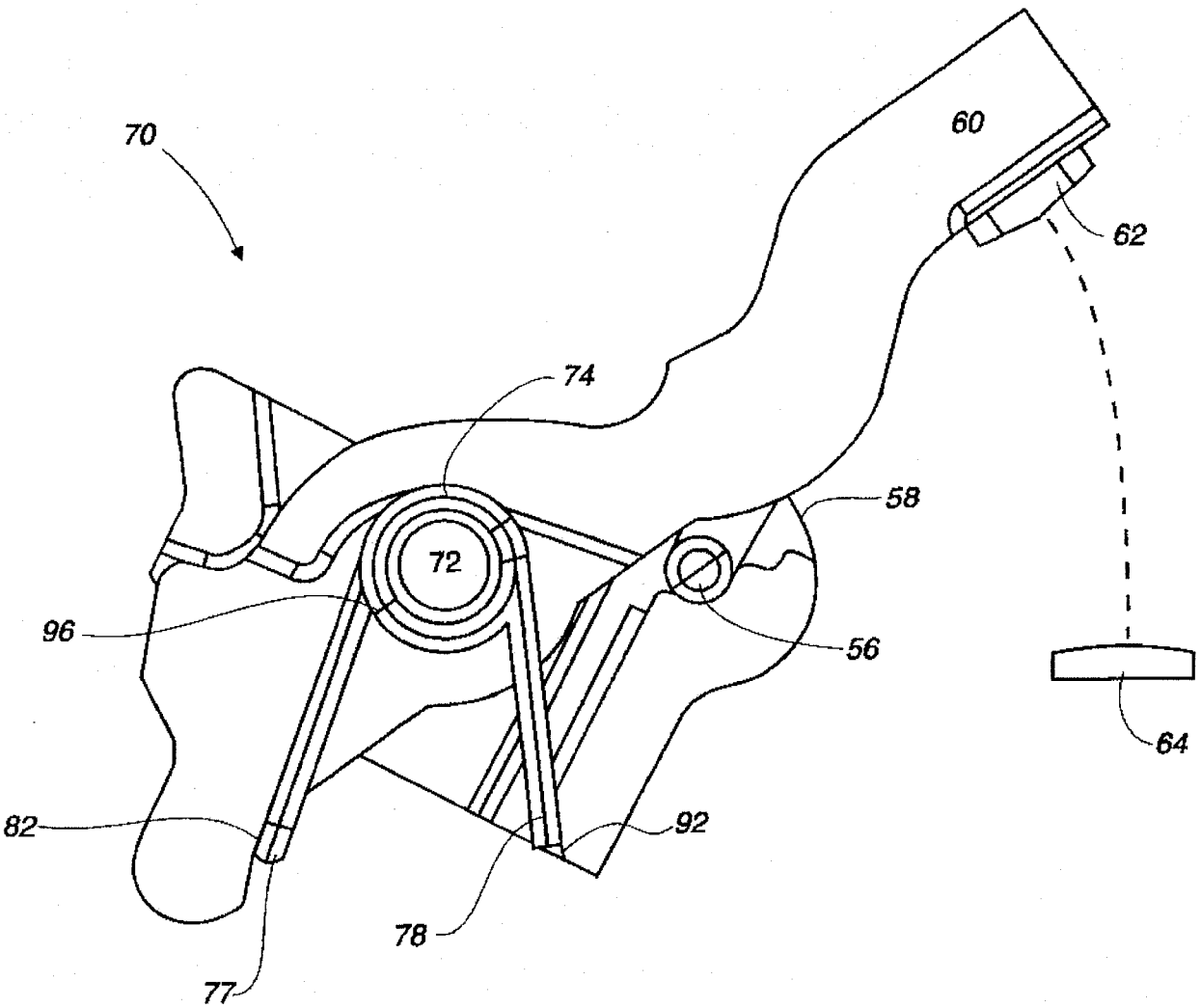
FIG. 3 is a side view of the blade suspension assembly in FIG. 1, shown in the tripped position.
Figure 4:
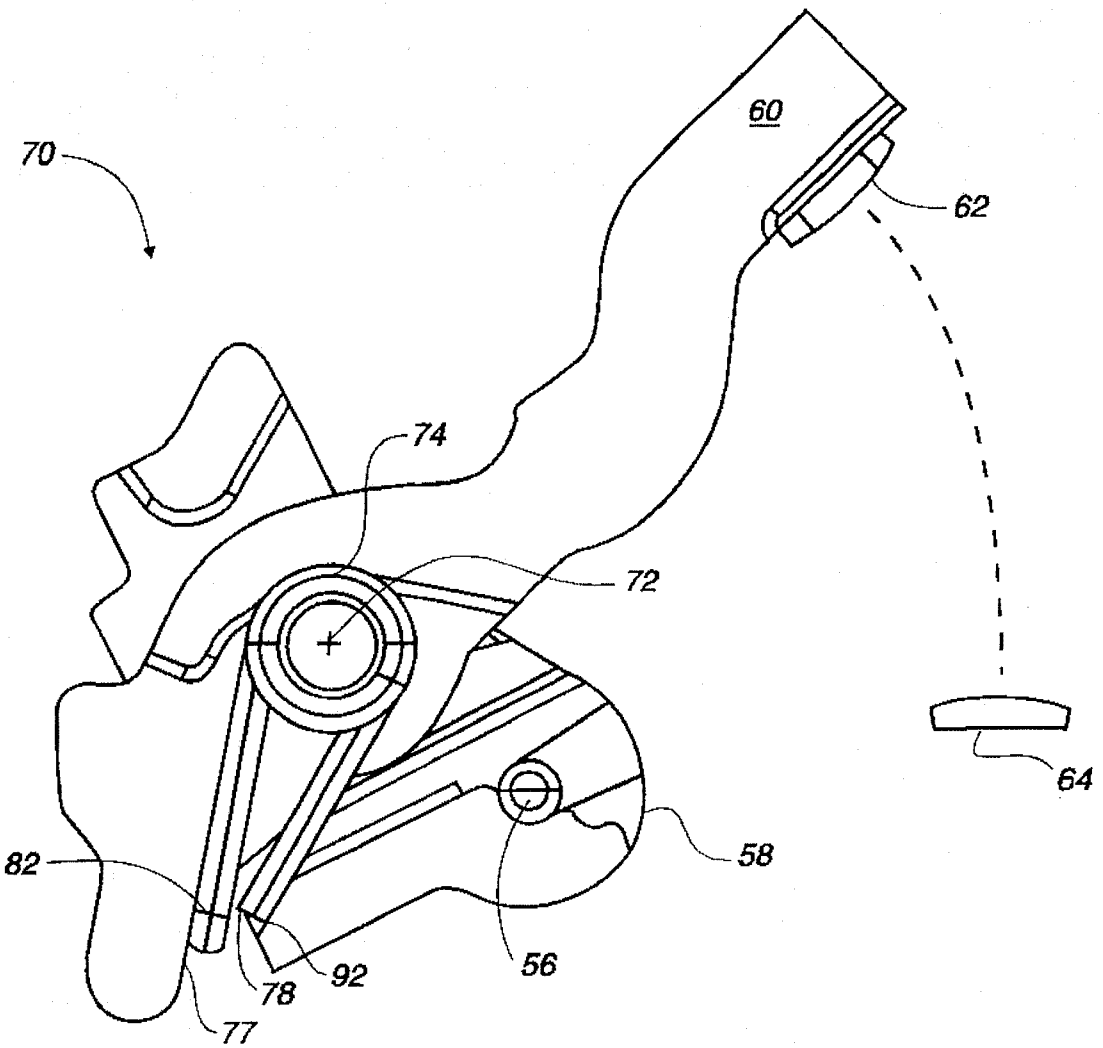
FIG. 4 is a side view of the blade suspension assembly in FIG. 1, shown in the blown open position.

While the invention is susceptible to various modifications and alternative forms, specific embodiments thereof have been shown by way of example in the drawings and will be described in detail. It should be understood, however, that the described embodiments are not intended to limit the invention to the particular form described. On the contrary, the intention is to cover all modifications, equivalents, and alternatives falling within the spirit and scope of the invention as defined by the appended claims.

DETAILED DESCRIPTION OF THE PREFERRED EMBODIMENT

Figure 5:
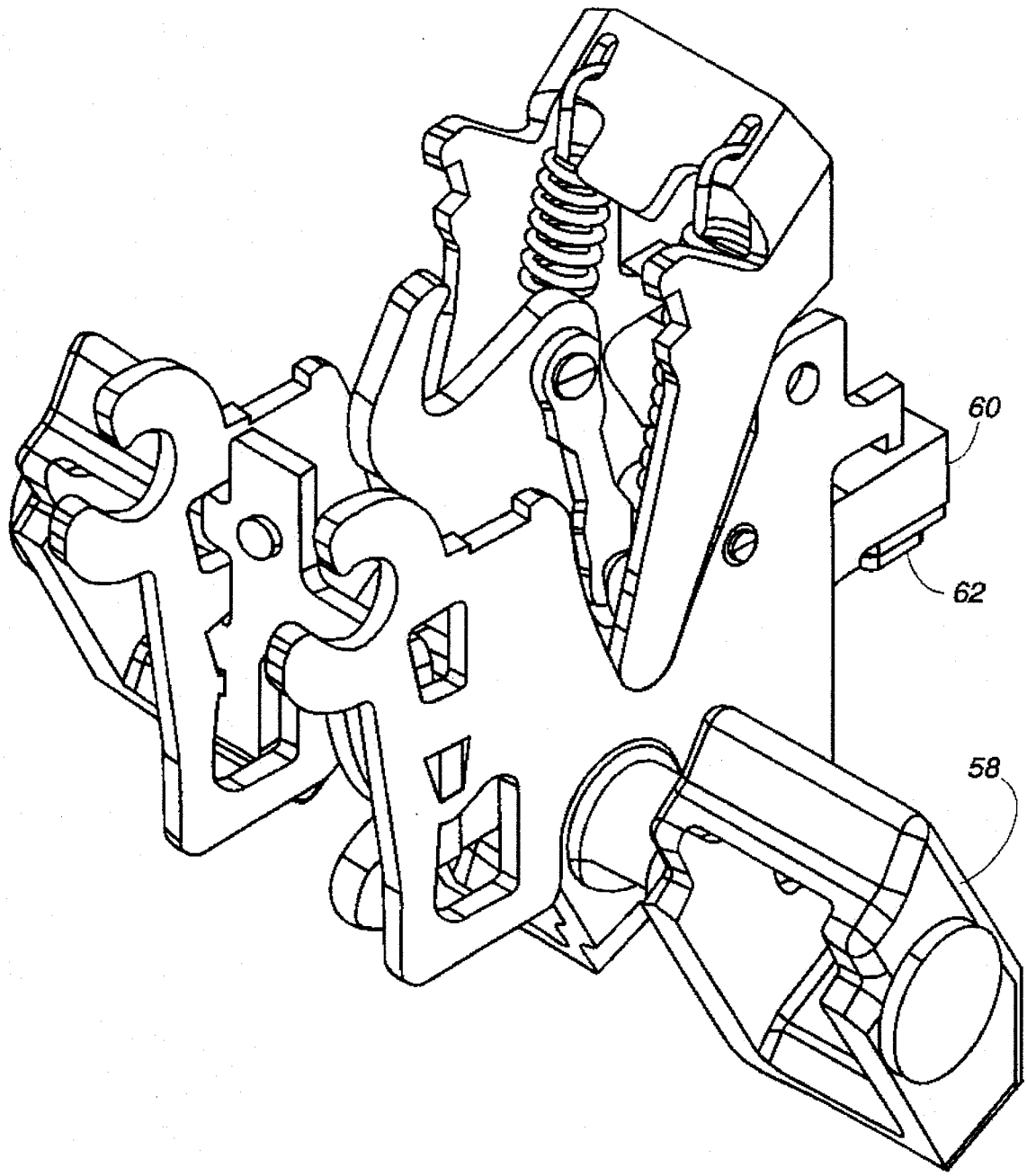
FIG. 5 is a perspective view of a blade/crade assembly shown in an untripped position.

Referring now to FIGS. 1 through 4, a blade suspension assembly 70 of a blade/cradle assembly depicted in FIG. 5 includes the elongated blade 60, a blade pivot pin 72, a torsion spring 74, and the blade crossbar 58. The torsion spring 74 includes a U-shaped middle portion 76 and a pair of end legs 78 disposed on opposite sides of the middle portion. The U-shaped middle portion 76 includes a lateral section 77 disposed substantially perpendicular to the end legs 78. In addition, the torsion spring includes a lateral hole 80 extending therethrough. The blade 60 includes the electrical contact 62 mounted to one end thereof, a lower narrow bearing surface 82 for supporting the lateral section 77 of the torsion spring 74, and a lateral circular aperture 84 for laterally receiving the pivot pin. The aperture 84 is disposed near the non-contact end of the blade 60.

Each pole of the blade crossbar 58 includes a pair of parallel opposing side walls 86, a front wall 88, and a back wall 90. A short linear portion of the respective junctions (corners) between the front wall 88 and the side walls 86 form a pair of bearing surfaces 92 for supporting the respective end legs 78 of the torsion spring 74. One of the bearing surfaces 92 supports one of the end legs 78, and the other of the bearing surfaces 92 supports the other of the end legs 78. The side walls 86 have formed therein respective notches 94 for receiving and supporting respective ends of the cylindrical pivot pin 72.

To assemble the blade suspension assembly 70, the torsion spring 74 is placed over the blade 60 such that the lateral section 77 of the torsion spring 74 abuts the lower bearing surface 82 of the blade 60, the end legs 78 are arranged on opposite surfaces of the blade 60, and the lateral hole 80 in the torsion spring 74 is disposed in line with the circular aperture 84 in the blade 60. The lateral section 77 of the torsion spring 74 is sufficiently wide to permit the U-shaped middle portion 76 to fit over the blade 60. Next, the blade pivot pin 72 is inserted through both the lateral hole 80 in the torsion spring 74 and the circular aperture 84 in the blade 60. Finally, the combination of the blade 60, the torsion spring 74, and the pivot pin 72 is inserted into the blade crossbar 58 with the pair of end legs 78 of the torsion spring 74 abutting the respective bearing surfaces 92 of the blade crossbar 58 and with the two ends of the pivot pin 72 located in their respective notches 94 formed in the side walls 86 of the blade crossbar 58.

When the torsion spring 74 is unstressed, the lower bearing surface 82 of the blade 60 and the bearing surfaces 92 of the blade crossbar 58 are positioned apart by a distance less than the distance between the lateral section 77 of the torsion spring and the end legs 78. Therefore, a predetermined amount of stress must be applied to the torsion spring 74 prior to loading the combination of the blade 60, the torsion spring 74, and the pivot pin 72 into the blade crossbar 58. This preloading stress compresses the end legs 78 of the torsion spring 74 toward the U-shaped middle portion 76 by a sufficient amount that the torsion spring 74 can be loaded into the blade crossbar 58. After loading the combination of the blade 60, the torsion spring 74, and the pivot pin 72 into the blade crossbar 58, this preloading stress is released, thereby charging the blade suspension assembly 70 with the contact force required for the circuit breaker application. That is, the torsion spring 74 exerts a force on the blade 60 so that its electrical contact 62 applies the required contact force to the opposing stationary contact 64 while the blade 60 is disposed in an untripped/closed position.

The circuit breaker may include multiple poles. FIG. 1 illustrates the blade suspension assembly 70 used for a three-pole circuit breaker. The blade crossbar 58 is provided with three separate compartments each of which houses a respective combination of the blade 60, the torsion spring 74, and the pivot pin 72. FIG. 1 depicts the blade suspension assembly 70 in both its assembled form and its unassembled form.

The blade suspension assembly 70 employs two methods of rotation to insure that the circuit breaker will clear any interruption within a specified interruption range. In the first method, the movable contact 62 is separated from the opposing stationary contact 64 by the rotation of the blade crossbar 58 and the blade 60 about a crossbar pivot 96 in response to a force applied to the drive pin 56 by the lower links 20 after the assembly 70 has opened due to the tripping of the thermal or magnetic trip unit. This first method is illustrated by the change from the closed position shown in FIG. 2 to the tripped position shown in FIG. 3.

The second method employs the blow-open characteristic designed into the blade suspension assembly 70. In particular, this method takes advantage of the repulsive electromagnetic force seen during a high level interruption to rotate the blade 60 about the pivot pin 72 away from a line terminal blow-off loop in opposition to the spring force created by the torsion spring 74. This second method is illustrated by the change from the closed position shown in FIG. 2 to the blown open position shown in FIG. 4.

While the invention has been particularly shown and described with reference to certain embodiments, it will be recognized by those skilled in the art that modifications and changes may be made to the present invention. Each of these embodiments and obvious variations thereof is contemplated as falling within the spirit and scope of the claimed invention, which is set forth in the following claims.

What is claimed is:

1. A blade suspension assembly for a circuit breaker, comprising:

a pivot pin;

a torsion spring including a lateral middle section and a pair of end legs disposed on opposite sides of said middle section, said torsion spring further including a lateral hole extending therethrough for laterally receiving said pivot pin;

an elongated blade including an electrical contact mounted thereto and a lower bearing surface for supporting said lateral middle section of said torsion spring, said blade further including a circular aperture for laterally receiving said pivot pin; and a blade carrier including a first pair of bearing surfaces for receiving and supporting respective ones of said pair of end legs of said torsion spring and a second pair of bearing surfaces for receiving and supporting opposite ends of said pivot pin, said blade carrier including a pair of opposing side walls, a front wall, and a back wall, said first pair of bearing surfaces being formed by junctions between said front wall and said pair of side walls.

2. The blade suspension assembly of claim 1, wherein said second pair of bearing surfaces are notches formed in said pair of side walls.

3. The blade suspension assembly of claim 1, wherein said torsion spring includes a U-shaped middle portion and said lateral middle section forms the base of said U-shaped middle portion, said lateral middle section being sized such that said U-shaped middle portion fits over said blade.

4. The blade suspension assembly of claim 1, wherein said pair of end legs are generally parallel to each other.

5. The blade suspension assembly of claim 4, wherein said lateral middle section is generally perpendicular to said pair of end legs.

6. A blade suspension assembly for a circuit breaker, comprising:

a pivot pin;

a torsion spring including a U-shaped middle portion and a pair of generally parallel end legs disposed on opposite sides of said middle portion, said U-shaped middle portion having a lateral middle section generally perpendicular to said pair of end legs, said torsion spring further including a lateral hole extending therethrough for laterally receiving said pivot pin;

an elongated blade including an electrical contact mounted thereto and a lower bearing surface for supporting said lateral middle section of said torsion spring, said blade further including a circular aperture for laterally receiving said pivot pin; and a blade carrier including a first pair of bearing surfaces for receiving and supporting respective ones of said pair of end legs of said torsion spring and a second pair of bearing surfaces for receiving and supporting opposite ends of said pivot pin, said blade carrier including a pair of opposing side walls, a front wall, and a back wall, said first pair of bearing surfaces being formed by junctions between said front wall and said pair of side walls, said second pair of bearing surfaces being notches formed in said pair of side walls.

7. A method of assembling a blade suspension assembly for a circuit breaker, comprising:

providing a pivot pin;

providing a torsion spring including a lateral middle section and a pair of end legs disposed on opposite sides of the middle section, the torsion spring further including a lateral hole extending therethrough;

providing an elongated blade including an electrical contact mounted thereto and a lower bearing surface, the blade further including a circular aperture;

providing a blade carrier including first and second pairs of bearing surfaces;

placing the torsion spring over the blade with the lateral middle section abutting the lower bearing surface of the blade, with the end legs disposed on opposite sides of the blade, and with the lateral hole in the torsion spring disposed in line with the circular aperture in the blade;

inserting the pivot pin through the lateral hole in the torsion spring and through the circular aperture in the blade to form a first assembly including the blade, the torsion spring, and the pivot pin;

applying a predetermined amount of stress to said torsion spring by compressing said lateral middle section of said torsion spring toward said pair of end legs; and after applying the predetermined amount of stress to said torsion spring, inserting the first assembly into the blade carrier with the pair of end legs abutting respective ones of the first pair of bearing surfaces and opposite ends of the pivot pin abutting respective ones of the second pair of bearing surfaces.

8. A blade suspension assembly for a circuit breaker, comprising:

a pivot pin;

a torsion spring including a lateral middle section and a pair of end legs disposed on opposite sides of said middle section, said torsion spring further including a lateral hole extending therethrough for laterally receiving said pivot pin;

an elongated blade including a first conductive contact mounted thereto and a lower bearing surface for supporting said lateral middle section of said torsion spring, said blade further including a circular aperture for laterally receiving said pivot pin, said blade being movable from a closed position to at least one open position in response to an overcurrent condition, said first contact abutting a stationary second conductive contact when said blade is in said closed position, said first contact being spaced from said second contact when said blade is in said open position; and a blade carrier including a first pair of bearing surfaces for receiving and supporting respective ones of said pair of end legs of said torsion spring and a second pair of bearing surfaces for receiving and supporting opposite ends of said pivot pin, said torsion spring biasing said blade toward said closed position and causing said first contact to apply a contact force to said second contact when said blade is in said closed position.

* * * * *